US005396429A

United States Patent [19]

Hanchett

[11] Patent Number: 5,396,429

[45] Date of Patent: Mar. 7, 1995

[54] TRAFFIC CONDITION INFORMATION SYSTEM

[76] Inventor: Byron L. Hanchett, 7112D Calabria Ct., San Diego, Calif. 92122

[21] Appl. No.: 906,827

[22] Filed: Jun. 30, 1992

[51] Int. Cl.[6] ..... G08G 1/01; G08G 1/052

[52] U.S. Cl. ..... 364/436; 364/438; 348/149; 340/910; 340/937

[58] Field of Search ..... 364/436, 437, 438, 444, 364/449, 460, 462; 340/990, 993, 937, 910; 342/454, 456, 463; 358/103, 108, 109, 139

[56] References Cited

U.S. PATENT DOCUMENTS

| | | | |
|---|---|---|---|
| 2,710,390 | 6/1955 | Forse | 340/40 |
| 4,023,017 | 5/1977 | Ceseri | 235/150.24 |
| 4,258,351 | 3/1981 | Shigeta et al. | 340/38 P |
| 4,398,171 | 8/1983 | Dahan et al. | 340/22 |
| 4,819,174 | 4/1989 | Furuno et al. | 364/444 |
| 4,847,772 | 7/1989 | Michalopoulos et al. | 364/436 |
| 5,061,996 | 10/1991 | Schiffman | 358/103 |
| 5,115,398 | 5/1992 | De Jong | 364/443 |
| 5,182,555 | 1/1993 | Sumner | 340/905 |
| 5,214,793 | 5/1993 | Conway et al. | 455/49.1 |
| 5,289,183 | 2/1994 | Hassett | 340/905 |

OTHER PUBLICATIONS

Jurgen; Smart Cars and Highway Go Global; IEEE Spectrum; May 1991; pp. 26–37.

J. E. Ferrell; *The Big Fix;* Los Angeles Time Magazine; Apr. 14, 1991; pp. 14, 16, 18 & Others.

S. Goldstein; *Getting Around Gridlock is Goal of High-(way)-tech Research Teams;* The San Diego Union; Sep. 30, 1990; pp. F-58 & Other.

E. Schine; *Here Comes the Thinking Car;* Business Week; May 25, 1992; pp. 84, 87.

M. Schrage; *Smart Highways -Too Clever to Succeed*?Innovation; Jun. 6, 1991; pp. Other & D12.

*Primary Examiner*—Michael Zanelli

*Attorney, Agent, or Firm*—Joseph F. McLellan

[57] ABSTRACT

A series of image sensors is spaced along a roadway at particular intervals to provide images of the traffic and an identification signal associating those images with the location of the particular sensor providing the images. A main station receives the images from all cameras and broadcasts an information signal comprising segments of those images and the identifications in a particular sequence in accordance with the predominant direction of travel on the roadway. User units include a receiver which displays the images so that the user may preview the roadway ahead to make route choices. In systems covering multiple roadways, the user may select images of the particular roadway to view. The receiver is also responsive to a local broadcast of the camera's identification signal to thereby determine the geographical location of the user and alert the user when particularly pertinent images are being displayed and when decision points are reached where the user must make a route change choice. In another aspect, speed data is also provided by each camera station along the roadway.

24 Claims, 5 Drawing Sheets

FIG. 5
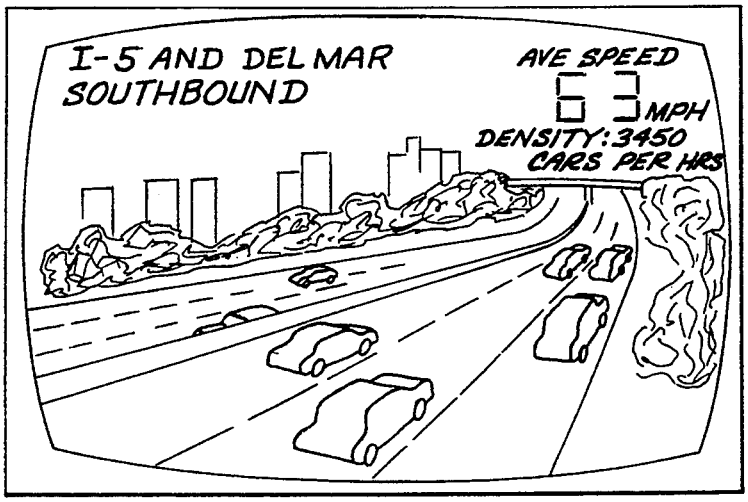
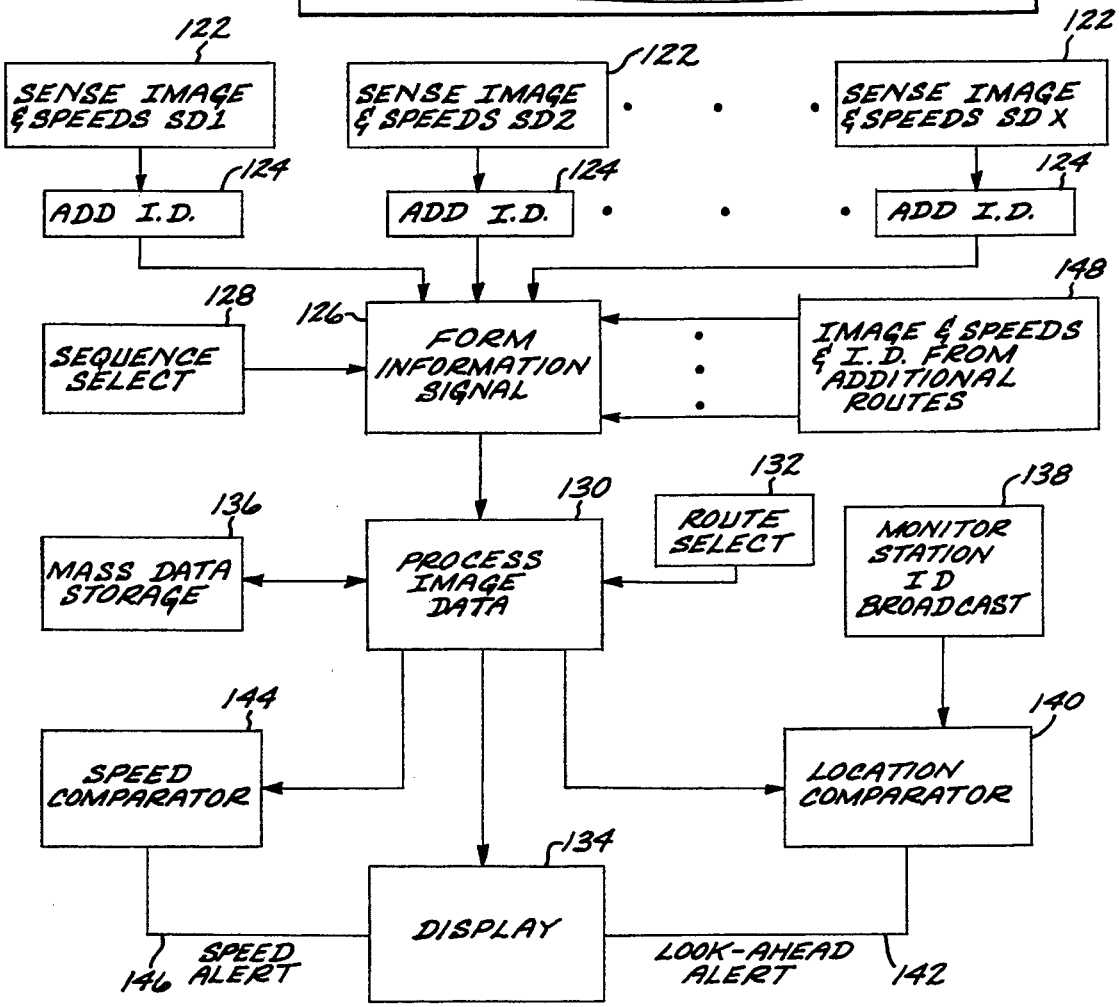
FIG. 6

TRAFFIC CONDITION INFORMATION SYSTEM

BACKGROUND

The invention relates generally to information systems and more particularly, to systems for monitoring traffic conditions and providing information about those conditions.

On roadways where a significant proportion of the traffic is attributable to commuters, traffic congestion is a routine problem. In some particularly crowded areas, such as metropolitan areas of the country, traffic during commuter hours slows to a stop. While stopped, vehicles are not transporting their drivers, passengers and cargoes to their destinations. The California South Coast Air Quality Management District estimates that Californians alone waste over 400,000 hours a day on the way to work. A by-product of these conditions is that stopped vehicles continue to expel hydrocarbons into the environment.

In addition to the adverse impact on the environment, there is typically an adverse impact on the work force. Many drivers of motor vehicles spend an enormous amount of time getting to and from their workplaces, homes and destinations. These same conditions are experienced during non-commuter times as the result of accidents, maintenance and construction, and unexpected other causes. Additionally, the large amount of time spent on crowded freeways with the inevitable traffic accidents, disabled vehicles, confrontations with other drivers, short tempers, poor drivers, and reckless and dangerous drivers accelerates tension and anger and results in increased stress levels and decreased job performance. By the time many drivers arrive at work, they have had at least one hour of high intensity traffic interaction sometimes including actions taken to avoid damage to property and harm to life and limb.

Many drivers have the option of selecting more than one route to reach their destinations. In many cases, certain routes are congested while others have little traffic. Communicating such traffic information visually on a route-by-route basis to drivers so that they may take the less congested routes would result in a more efficient and balanced use of the roadway system.

Certain locations along the routes offer decision points at which time the driver must decide to take one or another route. At these points, the driver must decide whether to continue ahead on the same route or change routes to get to the destination. After that decision point, the driver is committed unless another decision point lies ahead. In cases where the driver knows before a decision point that slow traffic conditions exist ahead on the present route but an alternate route is less congested, the driver can take the alternate route, thereby relieving traffic congestion, reducing the driver's travel time and reducing hydrocarbon emissions. Receiving timely, accurate, and sufficient information before reaching decision points is essential to the driver's decision process.

In some cases, drivers have flexible work schedules and can decide to arrive at their destinations at a later time if traffic conditions are presently unfavorable. However, sufficient accurate information is needed for the driver to make an informed decision. Delaying their entry onto the roadways will also result in a more balanced use of the roadways. This approach was extremely successful during the 1984 Summer Olympics in Los Angeles.

Several systems for monitoring traffic and informing motorists of traffic conditions have been used. In cities such as New York and Los Angeles for example, certain roadways are monitored by television cameras and sensors embedded in the pavement. These sensors relay information to a central control center where traffic problems are identified. Information can be sent to one or more message boards located on the roadway to inform drivers of problems, and in certain cases, access to particular segments of roadways can be controlled from the central control center by activating traffic control devices.

However in the case of Los Angeles, the message boards are few and give limited information. Although some can recommend an alternate route, a common complaint is that the information on the board is not accurate, current or sufficient to make an informed decision. Additionally, because there are so few message boards, decision points are often missed before the relevant message board is encountered.

In another example of traffic information systems, a series of low power radio transmitters were installed along a roadway in northern San Diego County, California which is heavily traversed by commuter traffic. These transmitters broadcast information on traffic conditions along the roadway on an AM frequency. Complaints from motorists that the information broadcast is not current enough to be helpful and that reception of the radio signal at points along the route is so poor that information could not be received are indicative of the drawbacks of such a system.

An additional consideration with the above systems is that someone other than the driver (the person tasked with making the decision) analyzes the traffic data and draws the conclusions (makes the decision for the driver) which are then communicated to drivers. An alternate system is one where the driver evaluates the information in light of his or her particular situation and draws the conclusion. For example, an operator in a central station may review the images provided by the roadway cameras and determine that a particular roadway is "clogged" and so indicate by the roadway message board along with a recommended alternate route. However, a driver examining the images reflecting conditions on the primary and alternate routes may determine that although the roadway is presently clogged, the pattern of traffic indicates that the roadway will become less congested shortly, or that staying on the primary route will result in the shortest travel time.

Hence, those skilled in the art have recognized the desirability of a traffic condition information system which provides a sufficient amount of current and accurate information concerning traffic conditions prior to decision points and decision times. It has also been recognized that it would be desirable to alert drivers of an upcoming decision point. The present invention fulfills these needs.

SUMMARY OF THE INVENTION

Briefly and in general terms, the traffic condition information system of the present invention comprises a plurality of monitor stations placed at intervals along a roadway of interest. Each monitor station includes an image sensor for sensing visual images of the traffic on that roadway and providing image signals representative of the sensed traffic image. Also provided is an identification means which associates that monitor station with the image signals provided. The identification means is used to determine the geographical position of the origin of the images. A controller receives the identified image signals and provides an information signal which comprises a sequence of image signal segments, each segment being images from a single monitor station. The information signal therefore comprises signals from a plurality of monitor stations. A user display unit displays images corresponding to the image signals in the segments along with the identification code so that a user can correlate the images displayed with the geographical position at which they were created.

In yet another aspect of the invention, each monitor station includes a speed sensor or sensors for providing data regarding the speed of the traffic at the position of the monitor station. The speed sensor signals are also communicated to the controller which then provides the speed data from all monitor stations to users along with the images and identification code. A speed comparator compares the speeds between sequential monitor stations and if the difference exceeds a threshold, a speed alert signal is provided the user.

In one aspect of the invention, the image signals provided by the monitor stations represent actual images of traffic existing at the monitor station. The user display unit translates the image signals back into the images of the traffic and displays these actual images. In another aspect, the monitor station provides image signals which are only representative of one of a plurality of predetermined and prerecorded traffic images. Images corresponding to such predetermined traffic conditions are stored at the display unit and upon receipt, the processor of the display unit retrieves the appropriate image from memory which corresponds to the image signal, and that retrieved image is displayed.

In a further aspect in accordance with the invention, a mobile monitor station, such as a helicopter, may be selectively positioned along the route. This mobile station provides image signals which may be given a priority and displayed immediately or may be included in the proper sequence of segments in the information signal and may be given an extended dwell time.

A position location means determines the position of the display unit, compares that position with the identification of the images being displayed, the identification being correlated with the geographic position of the monitor station providing those images, and a look-ahead alert signal is provided to the user when the images displayed are of a portion of the route which is a predetermined distance behind the display unit. In one case, the location means comprises an identification signal broadcast locally by each monitor station and received by the user unit. The broadcast identification signal is used to determine the geographic or relative position of the user unit to the images being displayed and the look-ahead alert signal is provided at the appropriate time.

In yet another aspect, a decision means is provided for indicating to the user a location on the route at which a decision must be made as to continuing on the present route or changing to another route.

In a further aspect, a storage unit is included with the display unit which stores parts of the information signal. This stored data may be redisplayed at the user's selection instead of received information signals. Such a feature is beneficial in the case where the main station broadcasts image data for more than one roadway; e.g., other primary routes or alternative routes, on the same frequency such that a waiting period exists between updates of images of the same roadway. The user unit's processor may store images of the roadway of interest and repeatedly display those stored images until the main station once again transmits new images of the roadway of interest. At this time, the receiver displays and stores the new images.

Other aspects and advantages of the invention will become apparent from the following detailed description and accompanying drawings, illustrating by way of example the features of the invention.

BRIEF DESCRIPTION OF THE DRAWINGS

FIG. 5 is a representation of a possible video display format of the traffic information signal of the present invention; and FIG. 6 is a flow chart of an embodiment of a method for providing traffic condition information in accordance with the principles of the invention.

DESCRIPTION OF THE PREFERRED EMBODIMENTS

Figure 1:
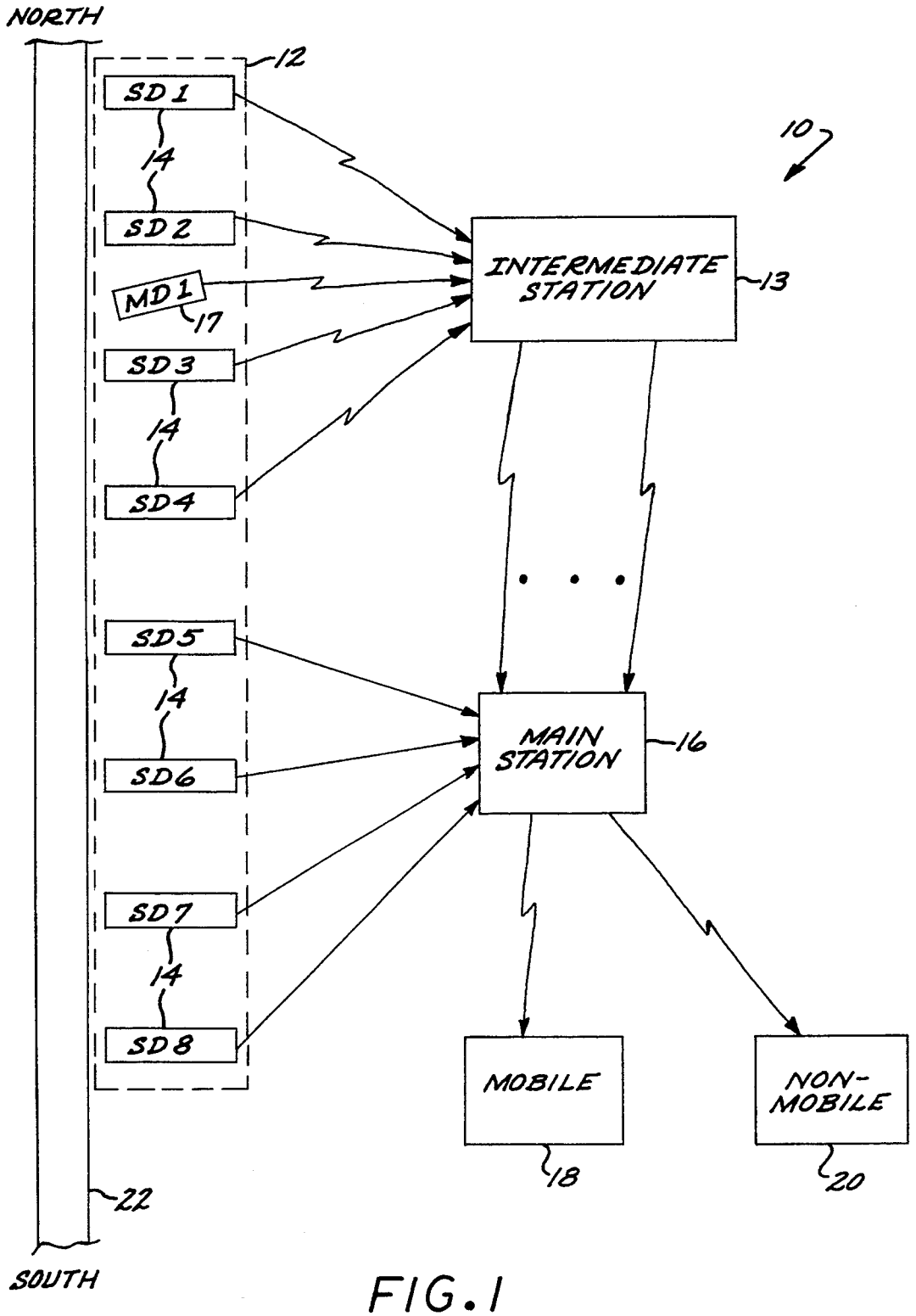
FIG. 1 is a schematic representation of a traffic condition information system in accordance with the principles of the present invention showing eight traffic monitor stations disposed along a roadway of interest, a main station, a mobile user unit and a non-mobile user unit.

Referring now to the drawings with more particularity wherein like reference numerals indicate like or corresponding elements among the several views, in FIG. 1 there is shown schematically a traffic information system 10 according to the present invention, which generally comprises a network 12 of traffic monitor stations 14 spaced apart from each other by approximately one mile, or at some other informative interval, a main station 16 which may be a land based transmitter or satellite, user units, which in this embodiment are shown as a mobile user unit 18 and a non-mobile user unit 20. FIG. 1 also presents an intermediate station 13 which receives signals from some of the monitor stations and forwards those signals to the main station 16. The monitor stations 14 are located along a roadway 22 of interest, such as an interstate freeway which in FIG. 1 is shown as proceeding in a north/south direction.

Figure 2:
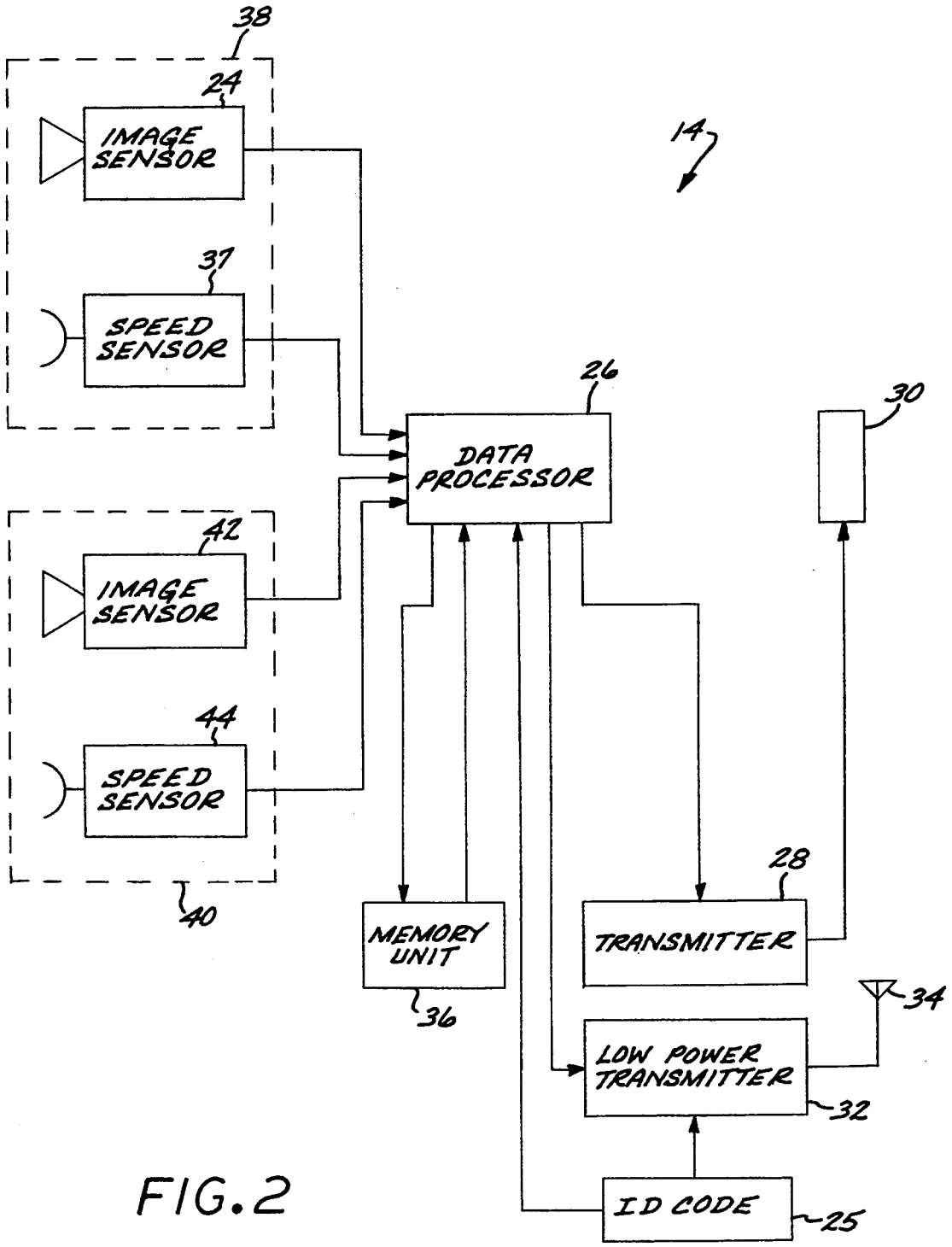
FIG. 2 is a schematic representation of a monitor station of FIG. 1 showing the component parts in more detail.

Referring now also to FIG. 2, each monitor station 14 includes an image sensor 24, such as a video camera, and a data processor 26. The data processor 26 receives the image signals from the image sensor 24, adds an identification code to them which is unique to this particular monitor station 14 and provides these combined signals to a transmitter 28. The identification code may be stored in a mass storage unit 36 or stored in a dedicated identification code storage unit 25. In another embodiment, the identification code that is unique to the monitoring station may be added at the main station before the visual image is broadcast by the main station to users. As used herein, a mass storage unit is meant to refer to devices such as magnetic disks, compact disks, magnetic tape and other such devices which provide storage of data and programs. Typically, memory chips are not used as power-off storage devices but in some cases they have been designed for just that purpose. Thus, they may also qualify as mass storage units in some cases.

The transmitter 28 provides the signal to a communication link 30 which may be an antenna for broadcast, a line, a fiber optic cable, or a combination of methods. The means or combination of means will depend on the topography and distances involved between the individual monitor stations and the main station 16. For example, in one case, all monitor stations 14 may be connected together by land line and this land line is connected to the intermediate station 13 which then broadcasts to the main station 16. In another case, the common land line between all monitor stations 14 may be directly connected to the main station 16 and no intermediate station 13 is used. In the example shown in FIG. 1, the intermediate transmitter 13 receives the data signals from monitor stations SD1 through SD3 and a mobile station MD1. The mobile monitor unit MD1 17 may comprise a helicopter or other vehicle. The mobile monitor 17 may supply image and speed signals as do the other monitor stations 14 or may simply supply image signals.

The monitor station 14 may also apply the identification code 25 to a carrier signal and broadcast the signal by means of a low-power transmitter 32 and an antenna 34. Further details of this feature are provided below.

The monitor station 14 in the embodiment of FIG. 2 also includes a speed sensor 37, which may be a Doppler RADAR unit, for detecting the speed of vehicles on the roadway 22 adjacent the particular monitor station 14. The signals from the speed sensor 37 are also provided to the processor 26 for communication to the main station 16.

In the embodiment shown in FIG. 2, the monitor station 14 includes a first sensor group 38 of a camera and speed sensor facing in one direction on the roadway 22 and a second sensor group 40 of a camera 42 and speed sensor 44 facing the opposite direction on the roadway 22. Alternatively, a single sensor group may be used which is mechanically moved to sense one or the other directions of the roadway as desired. On roadways having a configuration which would not accommodate a monitor station 14 with two sensor groups 38 and 40 or a single sensor group for monitoring both roadway directions, a separate monitor station on the other side of the roadway may be necessary.

Although a video camera is mentioned as an image sensor, this is only one example of an image sensor which may be used. Other sensors, such as charge coupled devices and infrared devices may be used.

The image sensor 24 of each monitor station 14 is preferably pointed in the same direction as the flow of the traffic being monitored to give the user of the information system a feeling of looking ahead. This makes it possible to have a sequential presentation of video images that simulates traveling the roadway 22 in the same direction as the mobile user 18 is traveling. To a user in a vehicle traveling on the monitored roadway 22, the effect will be that of observing the roadway coming up from behind the user's vehicle and then passing the user's vehicle. The effect might be likened to traveling the roadway at great speed to preview the traffic conditions. The image sensors 24 and 42 of each monitoring station 38 and 40 alternatively is directed opposite the direction of traffic monitored.

The image, speed and identification signals are provided to the processor 26 which either combines them or separately communicates them to the interim transmitter 31 or directly to the main station 16 as the case may be. Associating the identification code with the image and speed signals may be done by adding a certain number of bits at a certain position in the data stream. To identify the particular monitor station to the user, a video image comprising words or symbols describing the geographical location of the monitor station may be overlaid by the processor 26 on the image signals received from the image sensor and then the combined signals may be transmitted to the main station 16. Other techniques for identifying the monitor station 14 as having provided the image and speed signals may be used. For example, the particular broadcast frequency used by the monitor station 14 may be the identifying factor. The individual image, speed and identifier signals can be impressed on a carrier signal through multiplexing and the individual signals can be retrieved from the transmitted signal at the main station 16.

As an alternative, the speed and identifier data can be broadcast by the monitor stations 14 during the times that the image signal is not needed at the main station 16. Image signals typically require more processing time than speed and identification signals, thus during the time that image signals are not needed, efficiency can be improved by transmitting other data. As will be discussed below in more detail, the data from the monitor stations are interspaced with data from other monitor stations, thus there is "down time" for each monitor station. This "down time" may be substantial depending on the length of the route and the number of monitor stations along the route.

The monitor stations 14 may provide other information such as average vehicle speed and traffic density in cars per unit time. The speed sensor signals may be processed to provide an average speed reading which can also be communicated to the main station 16 by the processor 26. In more elaborate monitor stations 14, a speed sensor device for each lane of traffic may be installed to provide a lane-by-lane speed reading. Average speeds on a lane-by-lane basis could also be provided. Traffic density in cars per unit time could be provided by sensors in the pavement of the type currently in use in the Los Angeles freeway system and in more elaborate monitor stations, traffic density data per lane may be provided.

Alternatively, raw data may be forwarded to the main station 16 by the monitor stations 14 and the main station would calculate average speed and traffic density.

Each monitor station 14 in the embodiment of FIG. 2 transmits its identification signal at low power to the roadway local to it. As is described in more detail below, the receivers of the .mobile user units 18 can receive this separately broadcast identification signal, compare it to the identification signal associated with the images presently being received, and alert the user when an opportunity to look ahead is upcoming. The low power identification signal may be broadcast by numerous techniques, such as a digital code impressed on a carrier which may be deciphered by the mobile user receiver unit 18. Alternatively, location of the user unit may occur by other techniques, such as by satellite location.

The main station 16 acting as a controller receives the image and the speed signals representative of sensed traffic conditions and the identification code from each of the monitor stations 14 and broadcasts those signals in a selected order and for a selected amount of time per each monitor station 14 to user units 18 and 20. At the main station 16, individual signals from the respective monitor stations 14 are combined to produce a signal that comprises a predetermined sequential presentation of video images of the monitored roadway 22. This sequence is selected so as to offer relevant traffic condition information to the user and is generally selected to present images from the monitor stations 14 in the same order as the driver would encounter those images. For example, if the commuting direction in FIG. 1 is from south to north, the sequence of images will comprise images first from monitor station SD8, and then from SD7 and so on to images from SD1. The sequence would then be repeated starting with images from SD8.

The amount of time that the main station broadcasts images from each monitor station in the sequence depends upon the desired update frequency, the amount and significance of information to be assimilated by the user. For example, if an update to the information from each station is desired every five minutes, and there are fifty monitor stations 14, the main station 16 will only show images from each monitor station for approximately six seconds. In the case where equal time is not given to each monitor station 14, an average of six seconds would be given. For example, in some particularly congested areas, more time may be given to the local monitor station than to stations experiencing little or no congestion.

In another embodiment, multiple roadways may be monitored and the main station 16 would receive image and speed signals from the monitor stations 14 on those roadways also. In the case where the main station 16 broadcasts to users on only one frequency, the images of all roadways would be included in the broadcast. In this case, the total number of monitor stations along all roadways monitored must be considered when planning for the update frequency. Where the number of monitor stations is large, the amount of dwell time per each monitor station may need to be reduced. The roadway information signals from monitor stations on different roadways may be interleaved and the signals of interest are separated by the processor of the user unit.

In an additional feature, the data processor of the main station 16 can compare traffic speed data between consecutive monitor stations and if the change in speed exceeds a predetermined threshold, a speed alert signal is provided which would be communicated to the user. For example, where the speed at a first monitor station is fifty-five mph but the rate of speed at the next monitor station which is located one mile from the first station is only fifteen mph, a speed alert signal would be given to the user who is at the first monitor station. This warning may be an audio signal or a visual signal or both. This capability can be of extreme value in areas of airborne dust, fog or other visual impairment. In an alternate embodiment, the user unit 18 and 20 may perform the comparison of speeds between sequential monitor stations and provide the speed alert signal.

The ability to measure speeds along the route enables the user unit to calculate an approximate time of travel between selected points on the route. The user would enter the location of the points between which the travel time is desired on the keyboard and the processor would calculate the time from the last known speeds and display the calculated time.

Figure 3:
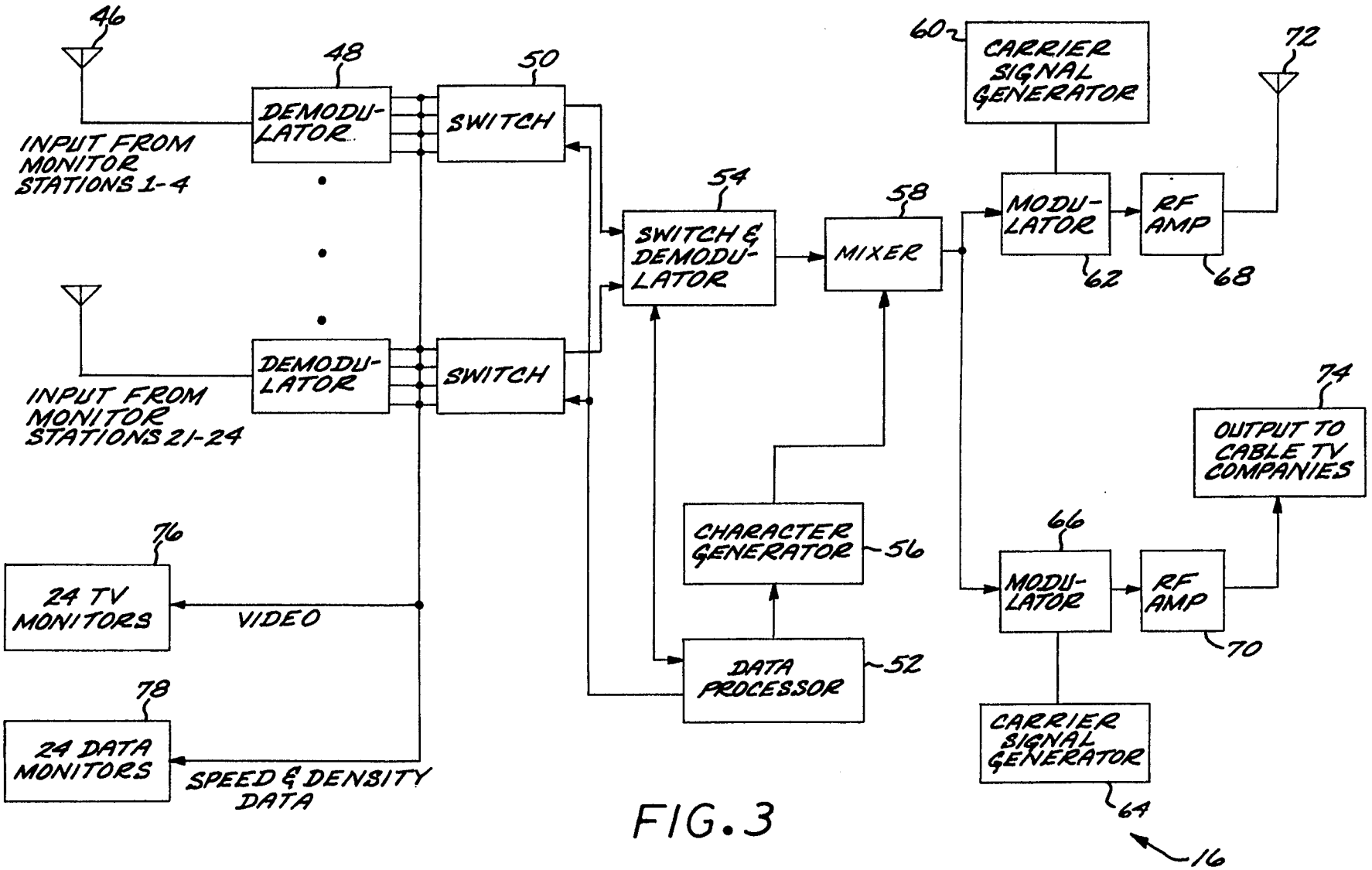
FIG. 3 is a block diagram of an embodiment of a main station.
Figure 4:
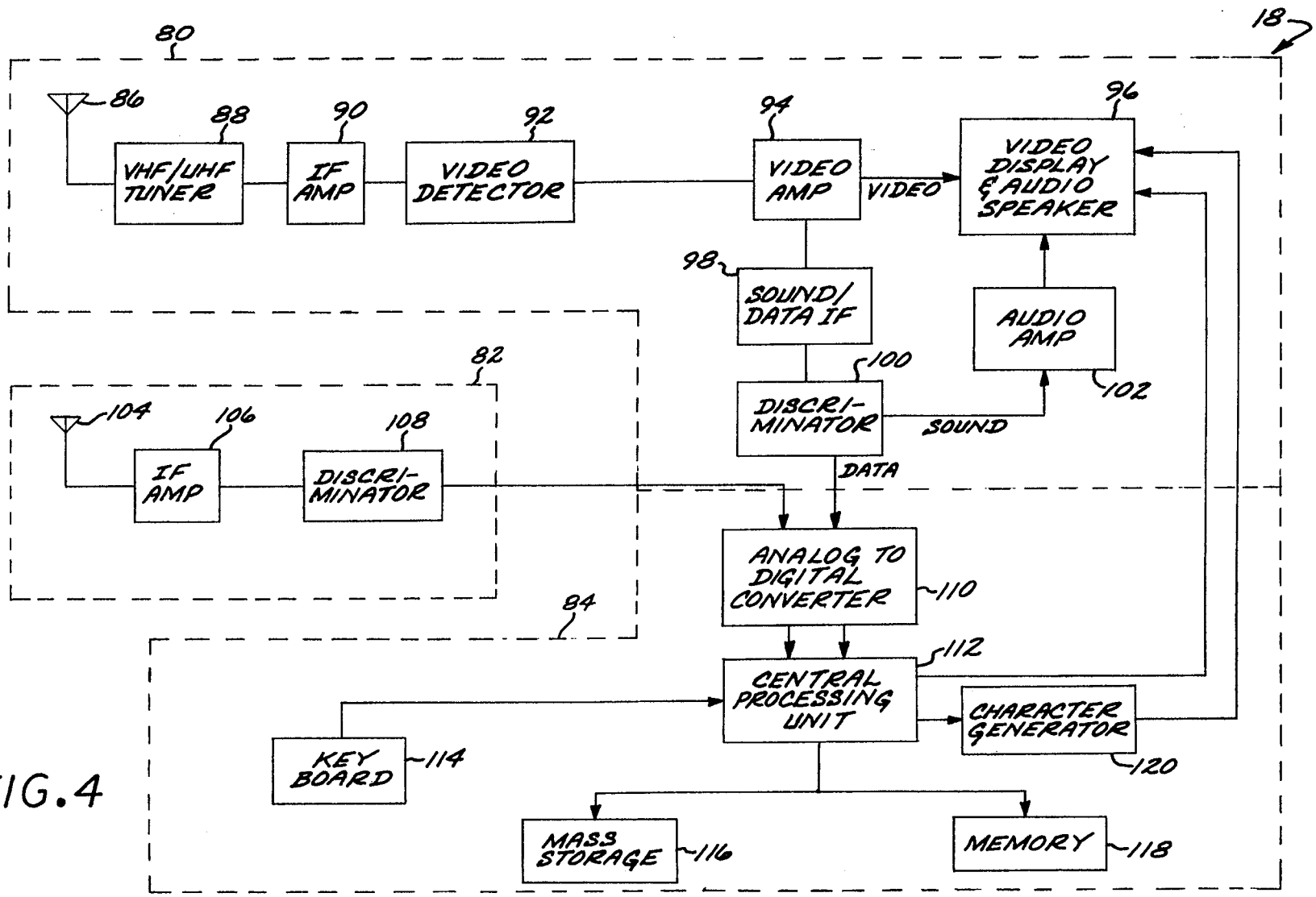
FIG. 4 is a schematic representation of a user unit of FIG. 1 showing component parts in more detail.

Referring now to FIG. 3, an example of a main station 16 is presented. A receiving antenna 46 is shown receiving the signals from monitor stations SD1 through SD4. Although only one antenna is shown in FIG. 4, there may be additional antennas used to receive signals from other monitor stations. Alternatively, one antenna may be used to receive all signals from the monitor stations. In another case, there may be direct connection to monitor stations or to an intermediate station as discussed above. From the receiving antenna 46, the signal is demodulated 48 and the individual video and data signals are input to a first switch 50. The first switch 50 is controlled by a processor 52 to select which monitor station video and data will be switched through to the second switch 54 which functions as a switch and a demodulator. The second switch is also controlled by the processor 52 to choose which input line is processed. The second switch selects the input line in accordance with the processor 52 command and demodulates the signal to separate the data, such as speed data. The speed data, for example, is provided to the processor 52 which provides the data to a character generator 56 which in turn provides characters representative of the speed to a mixer 58. The mixer 58 combines the video with the characters representative of the data and provides the combined signal to output stages. In the case shown in FIG. 3 the output stages comprise a first set of a carrier signal generator 60 and a modulator 62 and a second set of a carrier signal generator 64 and a modulator 66. Each of the modulated output signals is amplified 68 and 70 respectively, and is provided to an output device, such as a transmitting antenna 72 and a cable TV output 74.

Sequential video switches and microprocessor based switcher and control systems are well known in the art and are available; for example, from Burle. Video compression devices, encoding and decoding devices are available from Compression. Labs, Inc.

In addition, the main station 16 of FIG. 3 includes twenty-four television monitors referred to collectively by the numeral 76 for viewing the video output of each monitor station in the system. Also included are twenty-four monitors referred to collectively by numeral 78 for viewing the data from each of the monitor stations. By means of these monitors 76 and 78, the signals provided by each of the monitor stations 14 can be observed at the main station 16 simultaneously. In another embodiment, processors may be provided to superimpose the data of each monitor station on the video so that only twenty-four television monitors are needed. Additionally, monitors other than television monitors may be used, such as microcomputers with accompanying displays.

Turning now to the user units, and in particular, referring first to a mobile user unit, FIG. 4 includes a block diagram of an exemplary mobile user unit 18. The mobile user unit 18 comprises three main blocks; a television receiver block 80, an FM radio receiver block 82, and a personal computer block 84. The television receiver block 80 includes an antenna 86, a VHF/UHF tuner 88, an IF amplifier 90, a video detector 92 and a video amplifier 94. The video amplifier 94 provides the video signal to a video display device 96. A sound/data IF circuit 98 is connected to the video amplifier 94 and provides an IF signal to a discriminator 100 which provides a data signal to the personal computer block and a sound signal to an audio amplifier 102. The sound signal from the discriminator 100 may include alarms generated by the main station 16. The video display device 96 also includes an audio speaker for receiving the signal from the audio amplifier 102 and providing sound to the user in response thereto.

The FM radio receiver block 82 receives the locally broadcast identification signal from the monitor stations 14 with an antenna 104 and provides a data signal to the personal computer block 84 through an IF amplifier 106 and a discriminator 108.

The personal computer block 84 receives the identification data from the FM radio receiver block 82, converts from analog to digital 110, and provides the signal to the central processing unit 112. The analog to digital converter 110 also receives the discriminated 100 sound data from the television receiver block 80 and provides it to the central processing unit 112. The central processing unit 112 is also connected to a keyboard 114 or other data and command entry device, a mass storage unit 116, an operating memory 118 and a character generator 120. The central processing unit 112 includes a sound output for providing sound signals to the user display 96, such as look ahead alerts and speed change alerts. The character generator 120 is used by the central processing unit 112 to provide visual data to the user by means of the user display, such as an overlay of the monitor station identification presently being viewed.

The user display 96 is a CRT monitor or a flat panel display capable of presenting a television quality image from a signal input, herein termed a monitor. Other types of displays may be used for the user display 96, such as the type presently used by the airlines to present inflight movies, or display screens used in laptop computers. Some such CRT monitors operate on 12 volts dc, are currently available, and are used in recreational vehicles and trucks. An alternative for vehicles adaptable to the technology is a heads-up display where a virtual image of the display image is projected in front of the driver so as to be easily seen yet not interfere with forward vision. In another embodiment, only selected data may be presented on the heads-up display such as the speed and/or density information.

An identification of the location of the portion of the roadway presently being displayed is preferably superimposed on a portion of the displayed video image as shown in the example of FIG. 5. This identifier may be produced by the data processor 26 in the monitor station 14 (FIG. 2), or the processor 52 of the main station 16 or by the processor 112 of the user unit 18.

In the cases where the main station 16 or the user unit 18 creates the display of the location of the monitor station which provided the now displayed images superimposed over the traffic images, the identification code from the monitor station 14 would be received, compared to identification codes stored in memory or mass storage and the stored words or symbols corresponding to that identification code would be displayed.

In the embodiment of the user unit 18 where the processor 112 (FIG. 4) displays images in real time as they are received, little or no memory is required. However, in an embodiment offering image replay, memory 118 or mass storage 116 would be used to store image data for that replay. The stored data is refreshed each time the pertinent route sequence is received. The user can replay this stored information at will, such as during times when images from other routes are being received. In the embodiment offering image replay, the main station 16 would broadcast a time along with the visual image, and this time would be displayed to the driver indicating when the visual images were recorded thereby advising the driver as to how current they are. The processor 112 will store the latest images in the memory 118 or mass storage unit 116 and replay those images until new images are received for that route from the main station 16 at which time the new image data will be written into memory 118 or mass storage 116 over the old data. In this embodiment, all sequential displays of all routes monitored could be broadcast in real time in rotating fashion as first described; however, the selected route of the user could be stored in the memory unit 118 or mass storage unit 116 in real time and be refreshed as the broadcast from the main station 16 cycles again to the user selected route. The user can then replay the traffic information signal at will.

In the case where bandwidth is severely limited, it may not be practical to transmit video signals to user units 18. In such a case, prerecorded traffic images may be used. Images may be stored in the user unit 18 in the mass storage unit 116, such as on compact disk, and retrieved by the processor 112 when needed. The image signal provided by the monitor stations 14 may comprise a command to the user unit 18 to retrieve a particular one of the stored traffic condition images and display that image for that particular monitor station. In this case where actual video images of traffic are not transmitted, the signal from the monitor stations 14 is representative of the traffic sensed but is not representative of traffic images. In the case where signals containing actual video images are transmitted by the monitor stations 14, these transmitted signals are then representative of the traffic images. Thus, in the specification and in the appended claims, the term "image signal" broadly denotes an image signal representative of the traffic, including an image signal representative of traffic sensed, and an image signal representative of actual images of traffic.

In another embodiment, the monitor stations 14 may transmit signals which include images of traffic (representative of traffic images) but the bandwidth between the main station 16 and the user units 18 is limited. The main station may then transmit non-image traffic signals (signals representative of traffic sensed rather than signals representative of traffic images) to the user units which function as commands to the user units to retrieve pre-stored traffic images for display to the user. In another case, the monitor stations 14 may transmit signals only representative of sensed traffic (not image signals), the main station 16 may receive those signals and the pre-stored traffic images may be retrieved at the main station 16. Those pre-stored traffic images may then be transmitted to the user units 18.

The FM antenna 104 of the mobile user unit 18 in the embodiment of FIG. 4 also receives the local area broadcast of the identification signal from the closest monitor station 14. This directly received identification signal is provided to the CPU 112 and compared against the identification code which is part of the current images being displayed as received through the sound-/data IF 98 and the discriminator 100. When the sequence of images displayed cycles to images from the monitor station at or just behind the position of the mobile user, the processor 112 provides a look-ahead alert signal to the user that an opportunity is upcoming to look ahead at the roadway to be traveled. This look-ahead alert signal may be audible, visual or both. This feature automatically and conveniently locates the user in the sequence of images being displayed. The user would then view the display to see the images from the monitor station closest to the user and continue viewing to see traffic conditions at monitor stations ahead on the roadway.

In the systems where multiple roadways are monitored, the user may select the route to be monitored by the keyboard 114 and may then compare the traffic conditions on each route. The CPU 112 will then display only the images and other data pertaining to the selected route. Such sequences of monitor stations along routes; for example SD8 through SD1 on the northbound route and SD1 through SD8 on the southbound route, may be programmed into either the main station 16 processor 52 or in the user unit 18 processor 112. In the case where the sequence of stations is programmed in the main station 16, the main station receives the data signals from the monitor stations and assembles an information signal containing segments of the data signals from each of the monitor stations in the correct order. For example, on the northbound route, the first segment will contain data from SD8, the next segment will contain data from SD7 and so on.

In the case where the main station 16 only rebroadcasts the data signals received from the monitor stations, perhaps on separate frequencies, the user unit 18 will include the programmed sequences and will assemble the information signal to be displayed in a manner similar to the above description for the main station 16 in accordance with the selected sequence.

A further aid to the user's decisional process may be provided in an embodiment which identifies "decision points" to the user. As used herein, "decision points" are locations at which a user must decide to select an alternate route to reach the destination. In such a feature, the CPU 112 compares the identification signal data received from the low-power transmitter of the closest monitor station 14 to the identifications on the images being received. The CPU 112 will then issue an alert signal, either visually, audibly or both, to alert the user that a decision point has been encountered. The decision point alert signal may be given at a monitoring station located two miles before the decision point for example. The user may then view the images of the roadway ahead and images of alternate routes to aid in making the decision. Additionally, other means of alerting the user to a decision point may be used. For example, signs may be provided along the roadway signaling that the user is approaching a decision point. Such signing can be as simple as identifying a named off ramp on the freeway sign as the beginning of an alternate route.

The above examples of signal processing, transmission, and broadcasting are not meant to be restrictive of the invention. Other techniques may be used such as data bursting or data compression. In the case of data compression, the compressed data may be received by the user unit and stored in the mass storage unit 116 until that particular data is needed by virtue of a route selection by the user. The data is then decompressed and displayed. With such a technique, and with a data burst technique, a greater amount of data can be disseminated in a shorter period of time so that data updates may be accomplished more frequently. However, the system may become more costly which makes issues such as these the subject of specific cost benefit studies.

In the case where user memory or mass storage is limited, compressed or bursted data would have an identification code which would be recognized by the users' CPU 112 and only that data pertaining to the user's selected route would be stored.

Traffic speed data such as average traffic speed corresponding to traffic in each video image is preferably superimposed on a portion of the video image as also shown in FIG. 5. This data is preferably presented in a digital display format. In another embodiment, traffic density data, such as average cars per hour, or simply total cars per hour, is also superimposed on the visual image of the vehicles. Additional data presented may comprise an indication of the fastest and/or slowest lane.

Also, as discussed above, in one embodiment, the user is alerted to problem areas where the change in speed between monitor stations 14 exceeds a threshold. This feature may be expanded into a system-wide warning display where all slow spots are listed. In accordance with such a feature, the user may make a separate selection at the user unit 18 to list all congested areas. The user CPU 112 would then list all monitor stations 14 meeting the speed change criterion. Also the monitor stations 14 at which the speed is under a limit, such as twenty-five mph may also be listed. Additionally, image data from the mobile monitor stations 17, such as a helicopter, may be given a high priority and immediately placed in the information signal for display by the user units 14, regardless of its location along the route.

In a stationary or non-mobile user 20 environment, such as the office or home, where information on local traffic conditions is desired before venturing onto the roadway, route selection may be done by channel selection or a split-screen display for example. An interactive system such as is now used in pay-per-view systems can also be employed to provide viewer route selection. While the stationary or non-mobile user 20 would desire visual images of traffic conditions including speed at the monitor stations 14, the non-mobile user 20 does not need to receive the low power broadcast of the local monitor stations' identification signals and the user unit 20 would not include such a capability. Instead, the identification of the monitor station 14 closest to the user may be entered by the keyboard 114 and the user unit CPU 112 will then alert the user when images from that location are being displayed.

The non-mobile user 20 may view the traffic condition information signals over a cable television system. Satellite broadcast, or closed circuit television systems may be employed. The signal could also be viewed in other places such as a shopping centers or at a sports arena before traveling a monitored roadway 22.

The visual display of the sequential views of the roadways 22 allows the viewer to look ahead at traffic conditions and make informed route choices based thereon. Alternate routes may be selected for example, or a user's traveling schedule may be revised thus allowing greater balance and efficiency in roadway use.

In the example shown in FIG. 1, the network 12 of monitor stations comprises eight stations 14 but may comprise more or fewer depending on various factors. The example of eight is not meant to be restrictive of the invention. Although the application discussed herein is for automobiles, other applications may benefit from the disclosed system. For example, a railroad system may also find use for the invention.

Referring now to FIG. 6, the operation of one embodiment of the invention will be described. The monitor stations 14 sense 122 the images and speeds local to each, add their identification code 124 and transmit their data signals to the main station 16 processor 52. An information signal is formed 126 based on the route selection 128 made. For example, if it is morning, the appropriate route selection may be the south direction on route 22 (FIG. 1). The information signal is then formed 126 having segments of data from the monitor stations 14 in the same sequence as the drivers will encounter the monitor stations 14 along the route. The information signal is transmitted to the user units 18 for processing 130.

The user selects the route 132 desired for display and the CPU 112 begins the process of displaying 134 the appropriate segments of data. Additionally, the CPU 112 may store 136 certain data for later use. The user unit 18 receives the local broadcast signal 138 from the monitor station 14 in range and compares 140 the monitor station identification to the identification of the monitor station which supplied the currently displayed image and speed data. In the event that the image data being received is for a location behind the user unit by a predetermined amount, a look-ahead alert is provided 142.

The speeds at sequential monitor stations 14 may be compared 144 and if the difference in speed exceeds a predetermined threshold, a speed alert signal may be provided 146. The display unit 96 may display 134 the alert signals and/or provide audio alert signals.

In a further embodiment, monitor stations on other routes may provide image and speed data 148 to the main station 16. The main station 16 may then form the information signal to include information for these additional routes as described above.

While several particular forms of the invention have been illustrated and described, it will also be apparent that various modifications and improvements can be made without departing from the spirit and scope thereof. Accordingly, it is not intended that the invention be limited, except by the appended claims.

What is claimed is:

1. A traffic information system comprising:

a plurality of monitor stations spaced apart along a route, each monitor station adapted to provide image signals representative of the traffic existing at the particular location of the monitor station;

identification means for identifying the image signals as being originated by the respective monitor station which provided those image signals;

a controller which receives the image signals and provides an information signal comprising a sequence of image signal segments, each image signal segment comprising image signals from one particular monitor station, the sequence of the image signal segments comprising a sequence corresponding to the sequence of monitor stations encountered by the traffic on the route; and a display unit which receives the information signal and in response to each segment of image signals, displays images of traffic corresponding to those image signals and the identification of the respective monitor station which provided those image signals.

2. The system of claim 1 further comprising a main station located at a remote position in relation to the display unit, the main station including:

a sequence selector which selects a sequence of the monitor stations and provides a sequence signal representative thereof;

wherein the controller is located in the main station and is responsive to the sequence signal to organize the image signal segments in the information signal in accordance therewith.

3. The system of claim 1 further comprising a user unit which includes:

a sequence selector which selects a sequence of the monitor stations and provides a sequence signal representative thereof;

wherein the controller and the display unit are located in the user unit and the controller is responsive to the sequence signal to organize the image signal segments in the information signal in accordance therewith.

4. The traffic information system of claim 1 wherein:

each monitor station further comprises a speed sensor which senses the speed of traffic on the portion of the route local to the monitor station and provides a speed signal representative of that sensed speed;

the controller receives the speed signals from the monitor stations and includes them in the information signal; and the display unit displays the speed in association with the images of traffic provided by the respective monitor station.

5. The traffic information system of claim 4 further comprising speed comparison means for comparing the speeds between sequential monitor stations spaced apart along the route and for providing a speed alert signal when the speeds between two sequential monitor stations differ by a predetermined amount.

6. The traffic information system of claim 1 wherein the image signals are representative of actual images of the traffic existing at the respective monitor station providing the image signals; and wherein the display unit displays the actual images of traffic represented by those image signals.

7. The traffic information system of claim 1 wherein:

each image signal is representative of one of a plurality of predetermined images of traffic;

wherein the display unit is included in a user unit which further comprises a storage unit in which the predetermined images are stored; and wherein the display unit displays the image stored in the storage unit corresponding to the image signal received.

8. The traffic information system of claim 1 further comprising a mobile monitor station located at a selected position along the route, the mobile monitor station adapted to provide image signals representative of the traffic existing at the particular location of the mobile monitor station.

9. The traffic information system of claim 1 further comprising:

location means for determining the location of the display unit;

a user unit containing the display unit and further comprising:

an identification receiver which compares the location of the display unit provided by the location means to the location of the monitor unit providing the identified image signals received by the display unit; and look-ahead alert means for providing a look-ahead alert signal when the images displayed by the display unit are of a portion of the route a predetermined distance behind the location of the user unit.

10. The traffic information system of claim 9 wherein:
the location means comprises an identification signal broadcast by each monitor station to the route local to itself; and
wherein the identification receiver receives the broadcast identification signal to determine the location of the display unit.

11. The traffic information system of claim 1 further comprising decision means for indicating a location on the route at which a decision must be made as to continuing on the present route or selecting another route.

12. The traffic information system of claim 1 further comprising a user unit which includes the display unit and further comprises a storage unit which stores selected portions of the information signal and selectively recalls those stored portions for display by the display unit.

13. A traffic information system comprising:
a plurality of monitor stations spaced apart along a route, each monitor station adapted to provide image signals representative of images of the traffic existing at the particular location of the monitor station;
identification means for identifying the image signals as being originated by the respective monitor station which provided those image signals;
a main station located at a remote position in relation to the display unit, the main station including a controller which receives the image signals and provides an information signal comprising a sequence of image signal segments, each image signal segment comprising image signals from one particular monitor station;
a sequence selector which selects a sequence of the monitor stations and provides a sequence signal representative thereof;
wherein the controller is responsive to the sequence signal to organize the image signal segments in the information signal in accordance therewith;
a display unit which receives the information signal and in response to each segment of image signals, displays images of traffic represented by those image signals and the identification of the respective monitor station which provided those image signals.

14. The traffic information system of claim 13 wherein:
each monitor station further comprises a speed sensor which senses the speed of traffic on the portion of the route local to the monitor station and provides a speed signal representative of that sensed speed;
the controller receives the speed signals from the monitor stations and includes them in the information signal; and
the display unit displays the speed in association with the images of traffic provided by the respective monitor station.

15. The traffic information system of claim 13 further comprising:
location means for determining the location of the display unit;
a user unit containing the display unit and further comprising:
an identification receiver which compares the location of the display unit provided by the location means to the location of the monitor unit providing the identified image signals received by the display unit; and
look-ahead alert means for providing a look-ahead alert signal when the images displayed by the display unit are of a portion of the route a predetermined distance behind the location of the user unit.

16. A method for providing traffic information comprising the steps of:
monitoring the traffic at a plurality of positions spaced apart along a route and providing image signals representative of the traffic existing at each particular position;
identifying the image signals as being originated at each respective position along the route;
receiving the image signals and providing an information signal comprising a sequence of image signal segments, each image signal segment comprising image signals from one position along the route;
receiving the information signal; and
displaying images of traffic corresponding to each segment of image signals and identifying those displayed images with the respective position along the route to which the images correspond.

17. The method of claim 16 further comprising the steps of:
providing the image signals such that they are representative of images of the traffic existing at the respective position along the route;
selecting a sequence of the positions along the route and providing a sequence signal representative thereof;
organizing the image signal segments in the information signal in accordance with the selected sequence; and
displaying the images of traffic represented by those image signals.

18. The method of claim 16 further comprising the steps of:
sensing the speed of traffic at the position along the route;
providing a speed signal representative of that sensed speed;
including the sensed speed in the information signal; and
displaying the speed in association with the images of traffic provided at the respective position along the route.

19. The method of claim 18 further comprising the step of comparing the speeds between sequential positions along the route; and
providing a speed alert signal when the speeds between two sequential positions along the route differ by a predetermined amount.

20. A traffic information system comprising:
a plurality of monitor stations spaced apart along a route, each monitor station adapted to provide image signals representative of the traffic existing at the particular location of the monitor station;
identification means for identifying the image signals as being originated by the respective monitor station which provided those image signals;
a controller which receives the image signals and provides an information signal comprising a sequence of image signal segments, each image signal segment comprising image signals from one particular monitor station;
a display unit which receives the information signal and in response to each segment of image signals displays images of traffic corresponding to those image signals and the identification of the respective monitor station which provided those image signals; and a user unit which includes a sequence selector which selects a sequence of the monitor stations and provides a sequence signal representative thereof, the controller and the display unit being located in the user unit, and the controller being responsive to the sequence signal to organize the image signal segments in the information signal in accordance therewith.

21. A traffic information system comprising:

a plurality of monitor stations spaced apart along a route, each monitor station adapted to provide image signals representative of the traffic existing at the particular location of the monitor station, each monitor station comprising a speed sensor which senses the speed of traffic on the portion of the route local to the monitor station and provides a speed signal representative of that sensed speed;

identification means for identifying the image signals as being originated by the respective monitor station which provided those image signals;

a controller which receives the image signals and provides an information signal comprising a sequence of image signal segments, each image signal segment comprising image signals from one particular monitor station, the controller also receiving the speed signals from the monitor stations and including them in the information signal;

a display unit which receives the information signal and in response to each segment of image signals, displays images of traffic corresponding to those image signals and the identification of the respective monitor station which provided those image signals, the display unit also displaying the speed in association with the images of traffic provided by the respective monitor station; and speed comparison means for comparing the speeds between sequential monitor stations spaced apart along the route and for providing a speed alert signal when the speeds between two sequential monitor stations differ by a predetermined amount.

22. A traffic information system comprising:

a plurality of monitor stations spaced apart along a route, each monitor station adapted to provide image signals representative of the traffic existing at the particular location of the monitor station, each image signal being representative of one of a plurality of predetermined images of traffic;

identification means for identifying the image signals as being originated by the respective monitor station which provided those image signals;

a controller which receives the image signals and provides an information signal comprising a sequence of image signal segments, each image signal segment comprising image signals from one particular monitor station; and a user unit including a display unit which receives the information signal and in response to each segment of image signals, displays images of traffic corresponding to those image signals and the identification of the respective monitor station which provided those image signals, the user unit further including a storage unit in which the predetermined images of traffic are stored, and the display unit displaying the image stored in the storage unit corresponding to the image signal received.

23. A traffic information system comprising:

a plurality of monitor stations spaced apart along a route, each monitor station adapted to provide image signals representative of the traffic existing at the particular location of the monitor station;

identification means for identifying the image signals as being originated by the respective monitor station which provided those image signals;

a controller which receives the image signals and provides an information signal comprising a sequence of image signal segments, each image signal segment comprising image signals from one particular monitor station;

a display unit which receives the information signal and in response to each segment of image signals, displays images of traffic corresponding to those image signals and the identification of the respective monitor station which provided those image signals; and a mobile monitor station located at a selected position along the route, the mobile monitor station being adapted to provide image signals representative of the traffic existing at the particular location of the mobile monitor station.

24. A traffic information system comprising:

a plurality of monitor stations spaced apart along a route, each monitor station adapted to provide image signals representative of the traffic existing at the particular location of the monitor station;

identification means for identifying the image signals as being originated by the respective monitor station which provided those image signals;

a controller which receives the image signals and provides an information signal comprising a sequence of image signal segments, each image signal segment comprising image signals from one particular monitor station;

a display unit which receives the information signal and in response to each segment of image signals, displays images of traffic corresponding to those image signals and the identification of the respective monitor station which provided those image signals;

location means for determining the location of the display unit; and a user unit comprising the display unit and further comprising an identification receiver which compares the location of the display unit provided by the location means to the location of the monitor unit providing the identified image signals received by the display unit, and look-ahead alert means for providing a look-ahead alert signal when the images displayed by the display unit are of a portion of the route a predetermined distance behind the location of the user unit.

* * * * *